US011075450B2

(12) United States Patent
Yong et al.

(10) Patent No.: US 11,075,450 B2
(45) **Date of Patent: *Jul. 27, 2021**

(54) AOG ANTENNA SYSTEM AND MOBILE TERMINAL

(71) Applicant: AAC Technologies Pte. Ltd., Singapore (SG)

(72) Inventors: Zhengdong Yong, Shenzhen (CN); Chao Wang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 58 days.

This patent is subject to a terminal disclaimer.

(21) Appl. No.: 16/524,077

(22) Filed: Jul. 28, 2019

(65) Prior Publication Data

US 2020/0052394 A1 Feb. 13, 2020

(30) Foreign Application Priority Data

Aug. 12, 2018 (CN) ..... 201810910595.2

(51) Int. Cl.
*H01Q 1/40* (2006.01)
*H01Q 1/24* (2006.01)

(52) U.S. Cl.
CPC ..... *H01Q 1/40* (2013.01); *H01Q 1/243* (2013.01)

(58) Field of Classification Search
None
See application file for complete search history.

(56) References Cited

U.S. PATENT DOCUMENTS

2013/0082895 A1* 4/2013 Shiu ..... B05D 5/12 343/866
2016/0056544 A1* 2/2016 Garcia ..... H01Q 1/38 343/725
2016/0079663 A1* 3/2016 Youm ..... B29C 45/1671 343/702
2017/0186710 A1* 6/2017 Yoon ..... H01P 7/08
2019/0312334 A1* 10/2019 Shin ..... H01Q 9/0407

* cited by examiner

*Primary Examiner* — Crystal L Hammond
(74) *Attorney, Agent, or Firm* — W&G Law Group LLP

(57) ABSTRACT

A mobile terminal includes a 3D glass back cover and a main board opposite to and spaced apart from the 3D glass back cover. The AOG antenna system includes an antenna-in-package provided between the main board and the 3D glass back cover and electrically connected to the main board, and a metal antenna formed on a surface of the 3D glass back cover. A position of the metal antenna corresponds to a position of the antenna-in-package and the metal antenna is fed with power by coupling with the antenna-in-package. By providing a metal antenna, which is fed with power by coupling with the antenna-in-package, on a surface of the 3D glass back cover, the AOG antenna system provided greatly reduces the influence of the 3D glass back cover on the performance of the antenna, such that antenna radiation efficiency is high and the gain reduction is small.

10 Claims, 7 Drawing Sheets

AOG ANTENNA SYSTEM AND MOBILE TERMINAL

TECHNICAL FIELD

The present disclosure relates to the field of wireless communication technologies, and in particular, to an AOG (Antenna On Glass) antenna system and a mobile terminal.

BACKGROUND

With 5G being the focus of research and development in the global industry, developing 5G technologies and formulating 5G standards have become the industry consensus. The ITU-RWP5D 22nd meeting held in June 2015 by International Telecommunication Union (ITU) identified three main application scenarios for 5G: enhance mobile broadband, large-scale machine communication, and highly reliable low-latency communication. These three application scenarios respectively correspond to different key indicators, and in the enhance mobile broadband scenario, the user peak speed is 20 Gbps and the minimum user experience rate is 100 Mbps. Currently, 3GPP is working on standardization of 5G technology. The first 5G Non-Stand Alone (NSA) international standard was officially completed and frozen in December 2017, and the 5G Stand Alone standard was scheduled to be completed in June 2018. Research work on many key technologies and system architectures during the 3GPP conference was quickly focused, including the millimeter wave technology. The high carrier frequency and large bandwidth characteristics unique to the millimeter wave are the main means to achieve 5G ultra-high data transmission rates.

The rich bandwidth resources of the millimeter wave band provide a guarantee for high-speed transmission rates. However, due to the severe spatial loss of electromagnetic waves in this frequency band, wireless communication systems using the millimeter wave band need to adopt an architecture of a phased array. The phases of respective array elements are caused to distribute according to certain regularity by a phase shifter, so that a high gain beam is formed and the beam is scanned over a certain spatial range through a change in phase shift.

With an antenna being an indispensable component in a radio frequency (RF) front-end system, it is an inevitable trend in the future development of the RF front-end to system-integrate and package the antenna with a RF front-end circuit while developing the RF circuit towards the direction of integration and miniaturization. The antenna-in-package (AiP) technology integrates, through package material and process, the antenna into a package carrying a chip, which fully balances the antenna performance, cost and volume and is widely favored by broad chip and package manufacturers. At present, companies including Qualcomm, Intel, IBM and the like have adopted the antenna-in-package technology. Undoubtedly, the AiP technology will also provide a good antenna solution for 5G millimeter wave mobile communication systems.

Metal middle frames with 3D glass are the mainstream solution for future comprehensive screen phone structure design, which can provide better protection, aesthetics, thermal diffusion, chromaticity and user experience. However, due to a higher dielectric constant of 3D glass, the radiation performance of the millimeter wave antenna will be seriously affected, and the antenna array gain will be reduced, and so on.

Therefore, it is necessary to provide a new AOG antenna system to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Figure 1:
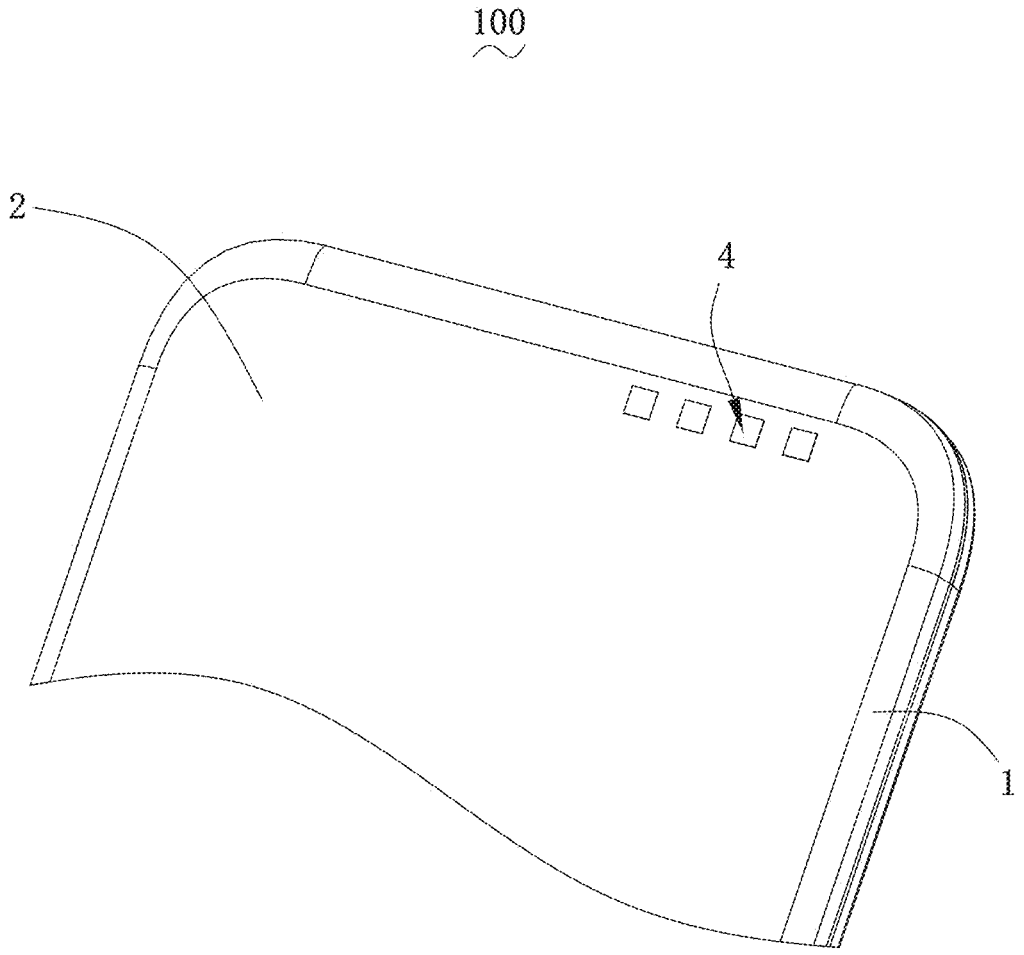
FIG. 1 is a partial structural schematic diagram of a mobile terminal provided by the present disclosure.
Figure 2:
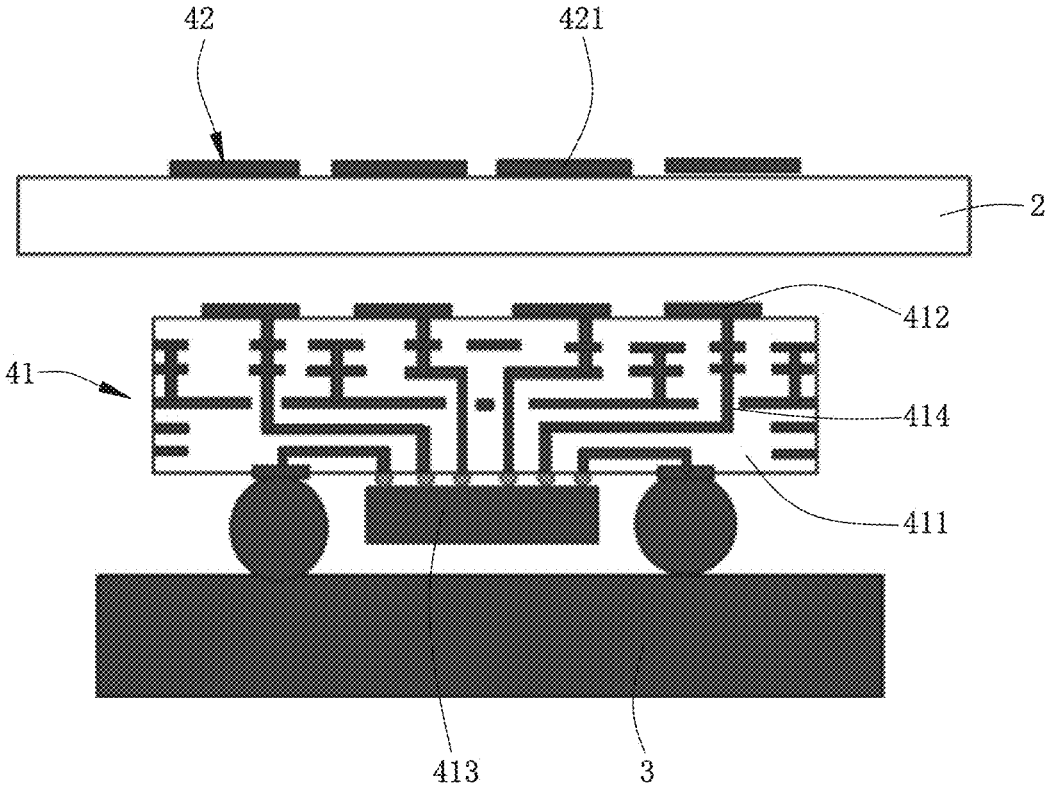
FIG. 2 schematically illustrates a connection of a 3D glass back cover, an AOG antenna system, and a main board in the mobile terminal shown in FIG. 1.

As shown in FIGS. 1-2, an embodiment of the present disclosure provides a mobile terminal 100, and the mobile terminal may be a mobile phone, an iPad, a POS machine, etc., which is not limited by the present disclosure. The mobile terminal 100 includes a frame 1, a 3D glass back cover 2 covering and connected to the frame 1 and enclosing a receiving space with the frame 1, a main board 3 that is received in the receiving space and spaced apart from the 3D glass back cover 2, and an AOG antenna system 4. The 3D glass back cover 2 can cover and be connected to the frame 1 by an adhesive, or the frame 1 and the 3D glass back cover 2 may be respectively provided with a corresponding buckle structure, such that the 3D glass back cover 2 can be fixedly connected to the frame 1 in a buckling manner. Alternatively, the frame 1 and the 3D glass back cover may be formed into one piece. The 3D glass back cover 2 can provide better protection, aesthetics, thermal diffusion, chromaticity, and user experience. The AOG antenna system 4 can receive and transmit electromagnetic wave signals, thereby achieving the communication function of the mobile terminal.

The AOG antenna system 4 is a millimeter wave phased array antenna system. Specifically, the AOG antenna system 4 includes an antenna-in-package 41 provided between the main board 3 and the 3D glass back cover 2 and electrically connected to the main board 3, and a metal antenna 42 formed on a surface of the 3D glass back cover 2. The metal antenna 42 corresponds to a position of the antenna-in-package 41 and is fed with power by coupling with the antenna-in-package.

Generally, due to the high dielectric constant of the 3D glass, using it as the back cover of the mobile terminal will seriously affect the radiation performance of the internally packaged millimeter wave array antenna, reduce the radiation efficiency, and reduce the gain and the distortion of the radiation pattern caused by the influence of surface waves. Typically, compared to free space antenna radiation, 3D glass having a thickness of 0.7 mm will result in a gain reduction of 2.5~3.5 dB and severe radiation pattern distortion. In the present disclosure, by using the 3D glass back cover 2 as a dielectric substrate of the antenna and providing a metal antenna 42, which is fed with power by coupling with the inner antenna-in-package, on a surface of the 3D glass back cover 2, the effect of the 3D glass back cover 2 on the antenna performance can be greatly reduced, thereby maintaining excellent antenna efficiency and avoiding distortion of the radiation pattern.

Specifically, the antenna-in-package 41 includes a substrate 411, a plurality of antenna-in-package units 412 provided on a side of the substrate 411 facing towards the 3D glass back cover 2, an integrated circuit chip 413 located on a side of the substrate 411 facing away from the 3D glass back cover 2, and a circuit 414 provided in the substrate 411 and connecting the antenna-in-package unit 412 with the integrated circuit chip 413. The circuit 414 is connected to the main board 3. Specifically, the antenna-in-package 41 can be connected to the main board through BGA package technology.

The metal antenna 42 can be formed on an inner surface of the 3D glass back cover 2, i.e., a surface of the 3D glass back cover 2 facing towards the main board 3, and can also be formed on an outer surface of the 3D glass back cover 2, i.e., a surface of the 3D glass back cover 2 facing away from the main board 3. In the present embodiment, the metal antenna 42 is formed on the outer surface of the 3D glass back cover 2.

Each surface of the 3D glass back cover 2 may be designed as a plane, alternatively, part of the surfaces are designed as a plane and the other part of the surfaces are designed as a curved surface, so as to meet the needs of different users on the products. The metal antenna 42 can be formed on the surface of the 3D glass back cover 2 by a printed conductive silver paste method or a printed LDS ink method. When the metal antenna 42 is formed on the outer surface of the 3D glass back cover 2, in order to prevent the metal antenna 42 from affecting the appearance of the mobile terminal 100, the metal antenna 42 may be designed to be located near the Logo, alternatively, a protective film may be applied to the surface of the metal antenna 42, which not only avoids affecting the appearance but also protects the antenna. The protective film is preferably a low dielectric film or plastic.

Further, the antenna-in-package 41 and the metal antenna 42 are both one-dimensional linear arrays, occupying a narrow space in the mobile phone, and are scanned only in one perspective, which simplifies design difficulty, test difficulty, and beam management complexity. As an example, the antenna-in-package 41 may be a linear array of 1×4, and the metal antenna 42 may also be a linear array of 1×4. Namely, the antenna-in-package 41 includes four antenna-in-package units 412, and the metal antenna 42 includes four metal antenna units 421. Each of the four metal antenna units 421 is spaced apart from and coupled to one of the antenna-in-package units 412.

Each of the antenna-in-package units 412 is connected to a phase shifter which is a 5-bit phase shifter with an accuracy of 11.25°.

Further, the antenna-in-package 41 can be selected from a group consisting of a square patch antenna, a ring patch antenna, a circular patch antenna, and a cross-shaped patch antenna; the metal antenna 42 can be selected from a group consisting of a square patch antenna, a ring patch antenna, a circular patch antenna, and a cross-shaped patch antenna. As an example, the antenna-in-package 41 and the metal antenna 42 can both be square patch antennas.

In this embodiment, the 3D glass back cover 2 has a dielectric constant of 6.3+i0.039 and a thickness of 0.7 mm; and the substrate 411 of the antenna-in-package 41 is made of 6 layers of high frequency low loss PCB sheets by pressing, in which a core layer is pressed with Rogers4350B and the thickness is 0.254 mm, while the remaining dielectric layers are pressed with Rogers4450F and the thickness is 0.2 mm. Without doubt, it should be noted that the present disclosure does not limit the dielectric constant of the 3D glass back cover 2, nor does it limit the number of layers, thickness, and manufacturing manner of the substrate 411 of the antenna-in-package 41.

Figure 3:
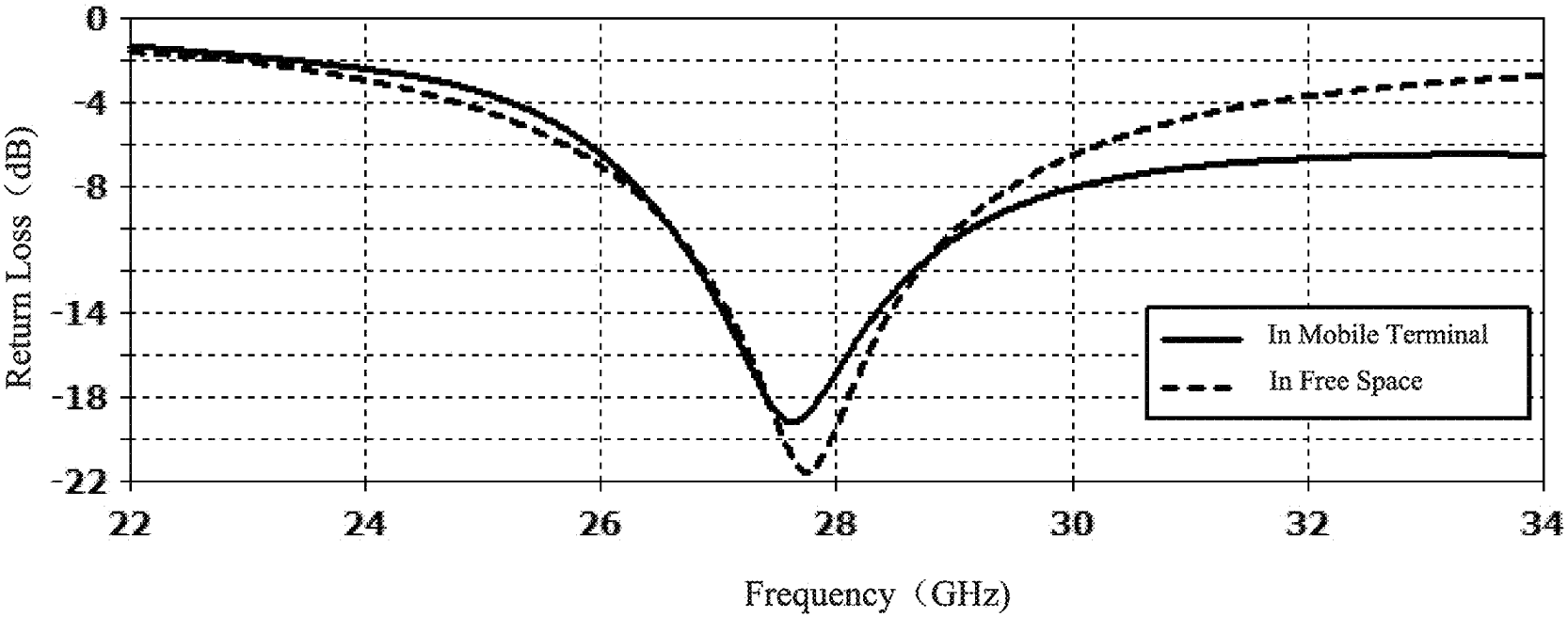
FIG. 3 illustrates a comparison of return loss of an AOG antenna system provided by the present disclosure in a mobile terminal with that in a free space.

Referring to FIG. 3, FIG. 3 illustrates a comparison of return loss of an AOG antenna system provided by the present disclosure in a mobile terminal with that in a free space. The solid line and the broken line respectively represent the return loss of an AOG antenna system in a mobile terminal and the return loss of an AOG antenna system in free space, and the free space herein refers to the case where the 3D glass back cover in the AOG antenna system provided by the present disclosure is removed. As can be seen from FIG. 3, compared to the case of free space, the broadband is almost unaffected when the AOG antenna system is in the mobile terminal, and the return loss in the bandwidth of 2.6 GHz (26.6~29.2 GHz) is S11<−10 dB.

Figure 4:
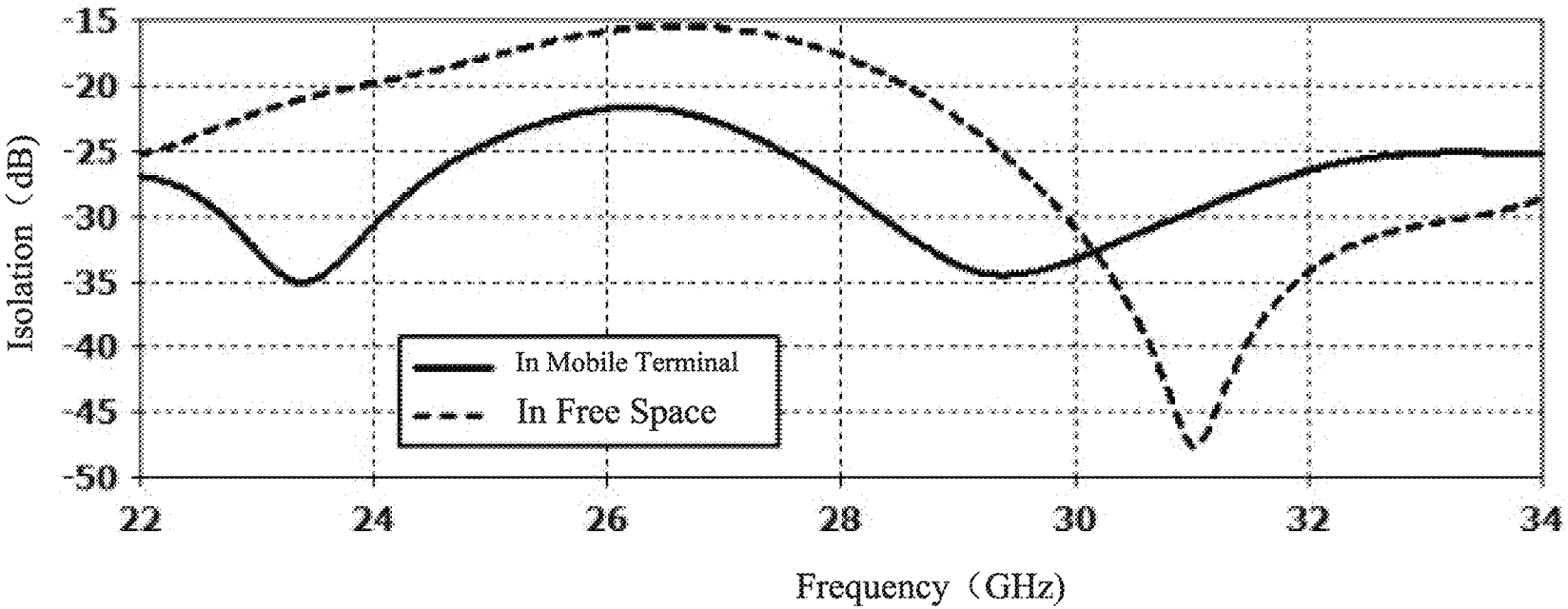
FIG. 4 illustrates a comparison of isolation of an AOG antenna system provided by the present disclosure in a mobile terminal with that in a free space.

Referring to FIG. 4, FIG. 4 illustrates a comparison of isolation of an AOG antenna system provided by the present disclosure in a mobile terminal with that in a free space. The solid line and the broken line respectively represent the isolation of the AOG antenna system in a mobile terminal and the isolation of the AOG antenna system in free space. As can be seen from FIG. 4, compared to the case of free space, the isolation between antenna units is improved when the AOG antenna system is in the mobile terminal, and isolation S21<−22 dB is satisfied in the bandwidth range.

Figure 5A:
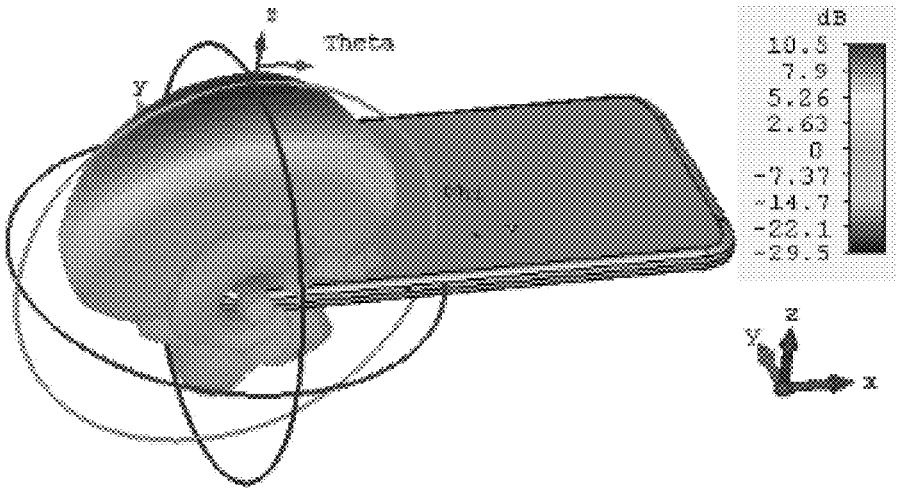
FIG. 5A illustrates a radiation pattern of an AOG antenna system provided by the present disclosure in a mobile terminal with a phase shift of each antenna unit being 0°.
Figure 5B:
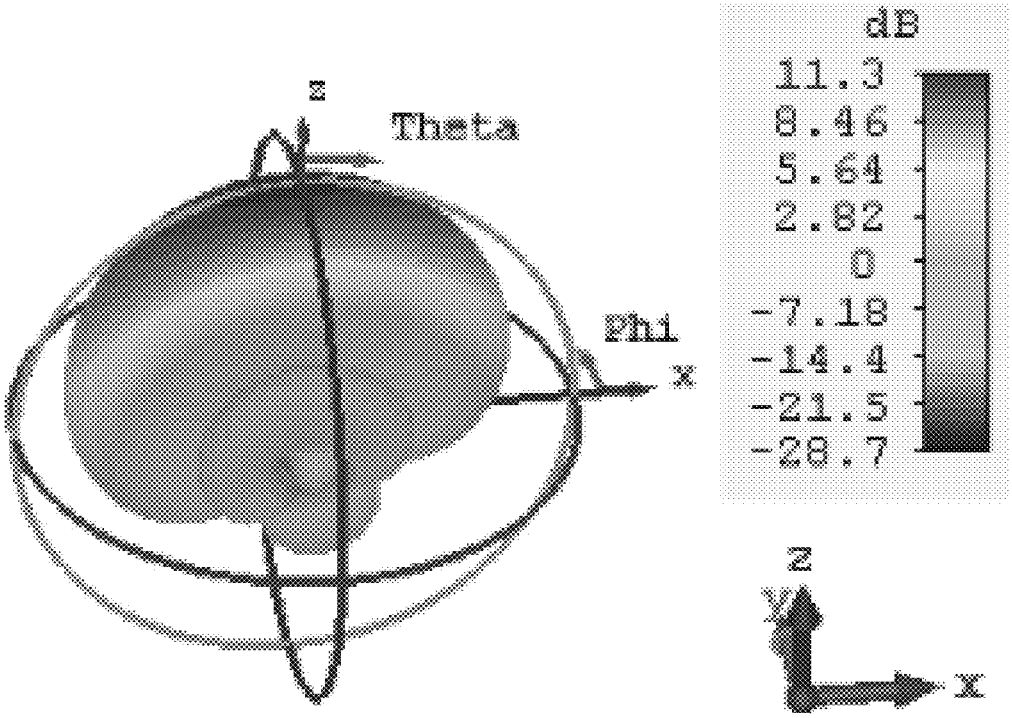
FIG. 5B illustrates a radiation pattern of the AOG antenna system provided by the present disclosure in a free space with a phase shift of each antenna unit being 0°.
Figure 6A:
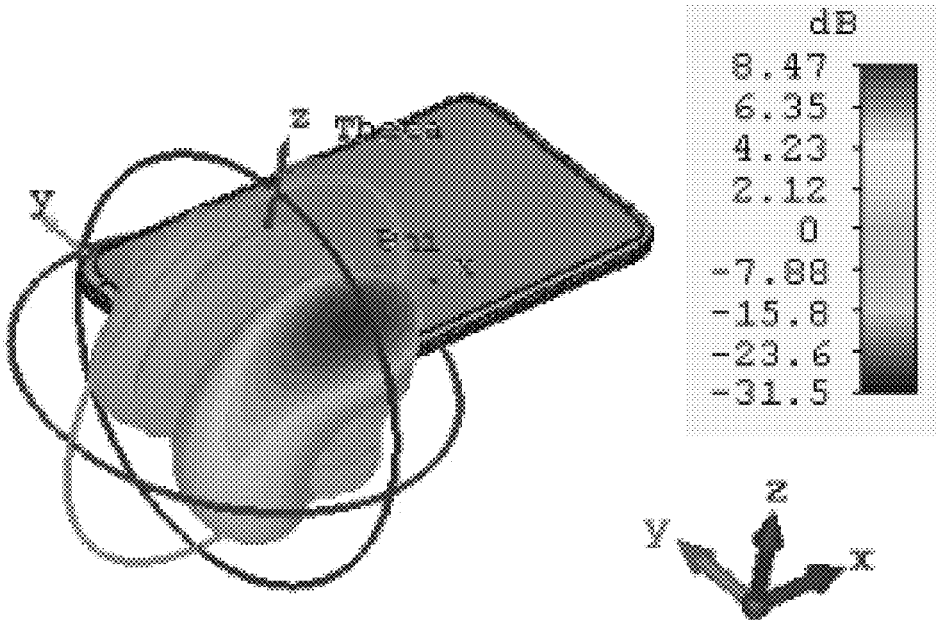
FIG. 6A illustrates a radiation pattern of an AOG antenna system provided by the present disclosure in a mobile terminal with a phase shift of each antenna unit being 45°.
Figure 6B:
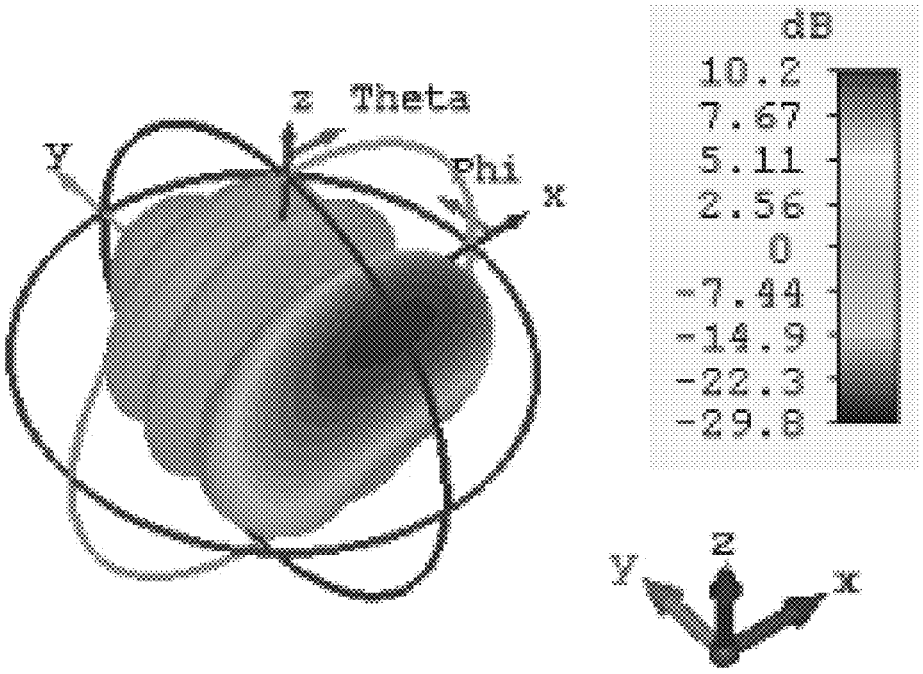
FIG. 6B illustrates a radiation pattern of the AOG antenna system provided by the present disclosure in a free space with a phase shift of each antenna unit being 45°.

Referring to FIG. 5A and FIG. 5B in conjunction, FIG. 5A and FIG. 5B respectively illustrate a radiation pattern of an AOG antenna system provided by the present disclosure in a mobile terminal and in a free space with a phase shift of each antenna unit being 0°. It can be seen from the figures that no pattern distortion occurs when the AOG antenna system is in the mobile terminal, and the gain is only reduced by 0.75 dB when the phase shift of each antenna unit is 0°; referring to FIG. 6A and FIG. 6B in conjunction, FIG. 6A and FIG. 6B respectively illustrate a pattern of an AOG antenna system provided by the present disclosure in a mobile terminal and in a free space with a phase shift of each antenna unit being 45°. As can be seen from the figures that no pattern distortion occurs when the AOG antenna system is in the mobile terminal, and the gain is only reduced by 1.75 dB when the phase shift is 45°. Therefore, it can be concluded that the effect of the 3D glass back cover on the inner antenna-in-package is greatly reduced after the metal antenna is provided on a surface of the glass back cover.

Figure 7:
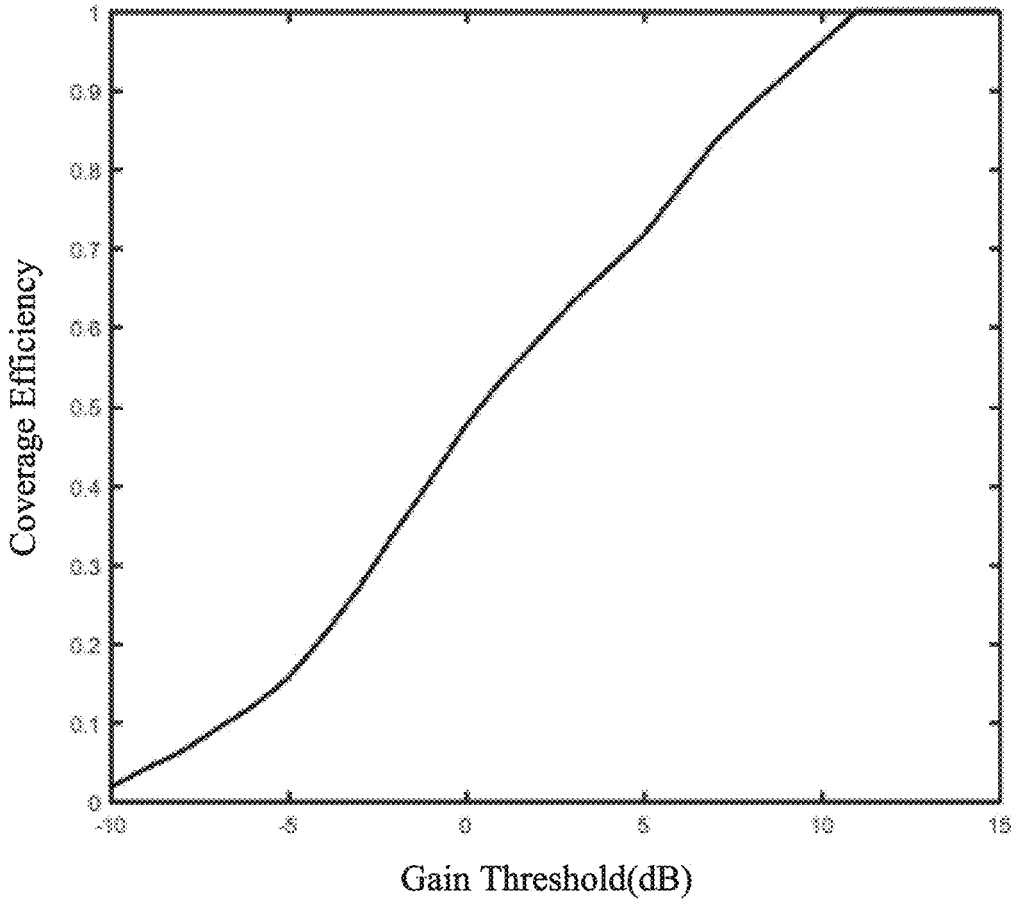
FIG. 7 illustrates a coverage efficiency graph of an AOG antenna system provided by the present disclosure.

Referring to FIG. 7, FIG. 7 is a coverage efficiency graph of the AOG antenna system provided by the present disclosure. It can be observed from FIG. 7 that the gain threshold is reduced by 11 dB for the case of 50% coverage efficiency, while the gain threshold is reduced by 12.98 dB for the case of 50% coverage efficiency in the 3GPP discussion. Therefore, the present disclosure is obviously superior to the average in the 3GPP discussion, showing that the AOG antenna system of the present disclosure has better coverage efficiency.

Compared with the related art, the AOG antenna system and the mobile terminal provided by the present disclosure have the following beneficial effects: the influence of the 3D glass back cover on the antenna performance is greatly reduced and the antenna radiation efficiency is high and the gain reduction is small, thereby guaranteeing the communication effect; the millimeter wave phased array antenna system adopts a linear array instead of a planar millimeter wave array antenna, occupies a narrower space in the mobile phone, and is only scanned in one perspective, which simplifies design difficulty, test difficulty, and beam management complexity.

What have been described above are only embodiments of the present disclosure, and it should be noted herein that one ordinary person skilled in the art can make improvements without departing from the inventive concept of the present disclosure, but these are all within the scope of the present disclosure.

What is claimed is:

1. An antenna on glass (AOG) antenna system, applied to a mobile terminal comprising a 3D glass back cover and a main board opposite to and spaced apart from the 3D glass back cover, wherein the AOG antenna system comprises:

an antenna-in-package provided between the main board and the 3D glass back cover and electrically connected to the main board, and a metal antenna formed on a surface of the 3D glass back cover, a position of the metal antenna corresponding to a position of the antenna-in-package and the metal antenna being fed with power by coupling with the antenna-in-package.

2. The AOG antenna system as described in claim 1, wherein the antenna-in-package comprises a substrate, an antenna-in-package unit provided on a side of the substrate facing towards the 3D glass back cover, an integrated circuit chip located on a side of the substrate facing away from the 3D glass back cover, and a circuit provided in the substrate and connecting the antenna-in-package unit with the integrated circuit chip, the circuit being connected to the main board.

3. The AOG antenna system as described in claim 2, wherein the AOG antenna system is a millimeter wave phased array AOG antenna system.

4. The AOG antenna system as described in claim 3, wherein both of the metal antenna and the antenna-in-package are one-dimensional linear arrays, the metal antenna comprises a plurality of metal antenna units, the antenna-in-package comprises a plurality of antenna-in-package units, and each of the plurality of metal antenna units is spaced apart from and coupled to one of the plurality of antenna-in-package units.

5. The AOG antenna system as described in claim 1, wherein the metal antenna is formed on a surface of the 3D glass back cover facing away from the main board by a printed conductive silver paste method or a printed LDS ink method.

6. The AOG antenna system as described in claim 1, wherein the metal antenna is formed on a surface of the 3D glass back cover facing towards the main board by a printed conductive silver paste method or a printed laser direct structuring (LDS) ink method.

7. The AOG antenna system as described in claim 1, wherein the antenna-in-package is selected from a group consisting of a square patch antenna, a ring patch antenna, a circular patch antenna, and a cross-shaped patch antenna.

8. The AOG antenna system as described in claim 1, wherein the metal antenna is selected from a group consisting of a square patch antenna, a ring patch antenna, a circular patch antenna, and a cross-shaped patch antenna.

9. The AOG antenna system as described in claim 1, wherein a surface of the metal antenna is coated with a protective film.

10. A mobile terminal, comprising the AOG antenna system as described in claim 1.

* * * * *